US008647096B2

(12) United States Patent
Meinecke

(10) Patent No.: US 8,647,096 B2
(45) Date of Patent: Feb. 11, 2014

(54) PRODUCTION OF A CREPED MATERIAL FOR CONNECTIONS AND TRANSITIONS ON BUILDINGS

(75) Inventor: Bernd Meinecke, Wiesbaden (DE)

(73) Assignee: Ewald Doerken AG (DE)

( * ) Notice: Subject to any disclaimer, the term of this patent is extended or adjusted under 35 U.S.C. 154(b) by 480 days.

(21) Appl. No.: 12/014,621

(22) Filed: Jan. 15, 2008

(65) Prior Publication Data

US 2008/0237918 A1 Oct. 2, 2008

(30) Foreign Application Priority Data

Jan. 24, 2007 (EP) ..... 07001459

(51) Int. Cl.
*B21C 3/16* (2006.01)

(52) U.S. Cl.
USPC ..... 425/112; 425/335; 425/336; 425/394; 425/406; 264/282

(58) Field of Classification Search
USPC ..... 264/282; 425/335, 336, 394, 406
See application file for complete search history.

(56) References Cited

FOREIGN PATENT DOCUMENTS

| | | | |
|---|---|---|---|
| DE | 2 118 517 | A1 | 12/1971 |
| EP | 1 634 660 | A1 | 3/2006 |
| GB | 2 076 715 | A | 12/1981 |
| SU | 1222341 | A | 4/1986 |

*Primary Examiner* — Yogendra Gupta
*Assistant Examiner* — John Robitaille
(74) *Attorney, Agent, or Firm* — Kaplan, Breyer, Schwarz & Ottesen, LLP

(57) ABSTRACT

For producing a creped material, especially a sealing material for connections and transitions on buildings, with this material being provided with crepe folds, wherein the crepe folds run in different directions, a method is disclosed with the steps of: a) preparing a deformable material web (9) with a main expansion direction (90); b1) forming a longitudinal profile (91) in at least one region of the deformable material web (9), wherein the longitudinal profile runs essentially parallel to the main expansion direction (90); c) forming a transverse profile (94) in at least one region of the deformable material web (9), wherein the transverse profile (94) runs at an angle other than 180° relative to the main expansion direction (90); and d) pressing at least one section of the deformable material web (9) that has at least one region with a longitudinal profile (91) and a transverse profile (94), so that the material web (9) is provided with the crepe folds. Roller arrangements for performing the method are also disclosed.

10 Claims, 8 Drawing Sheets

Figure 1:
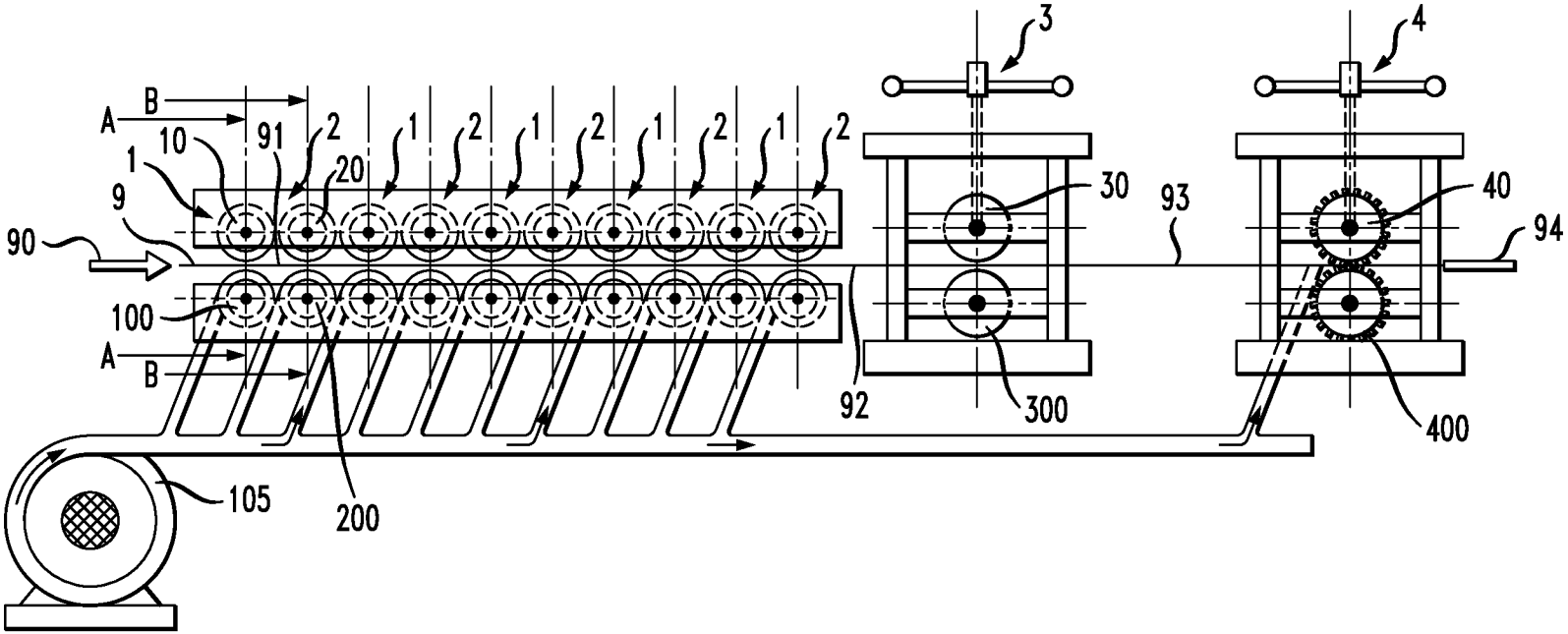

FIG. 9A
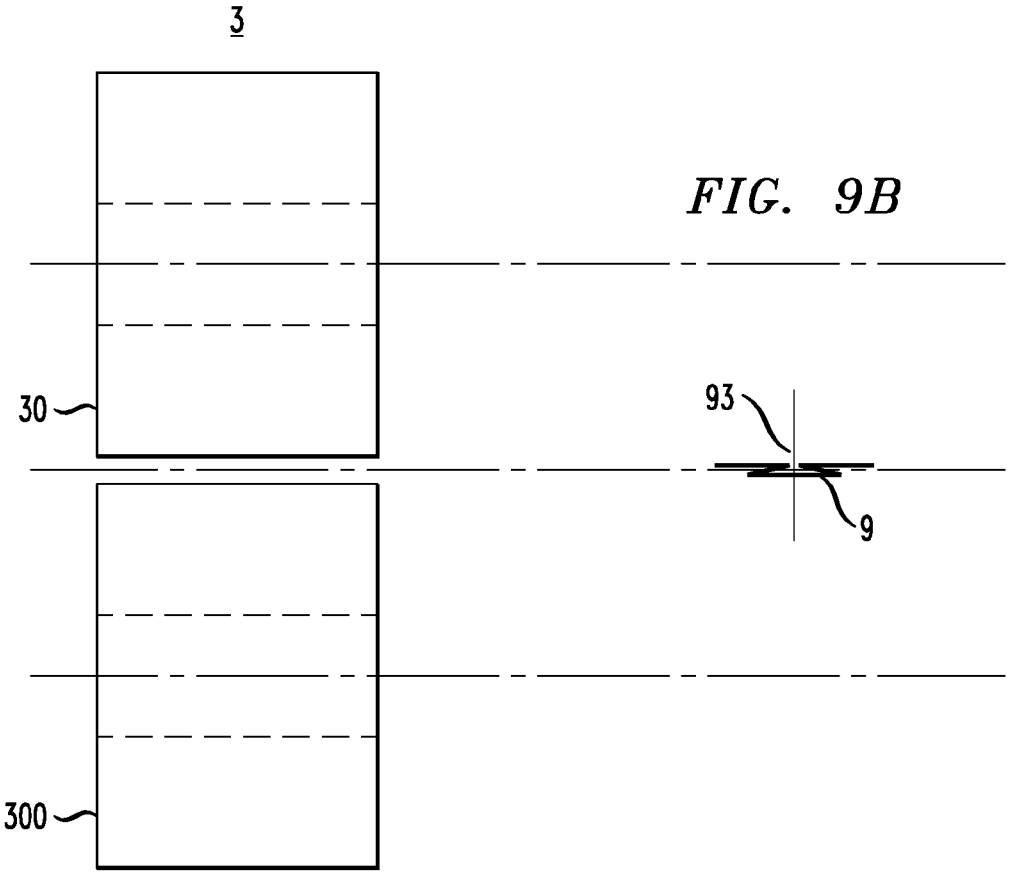
FIG. 9B
FIG. 10
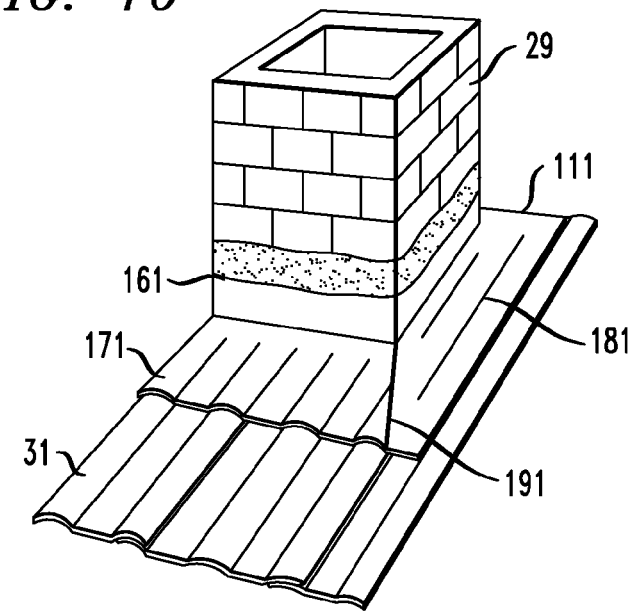

PRODUCTION OF A CREPED MATERIAL FOR CONNECTIONS AND TRANSITIONS ON BUILDINGS

The invention relates to a method for producing a creped material, in particular, a sealing material for connections and transitions on buildings, which is provided in two dimensions with crepe folds, as well as a roller arrangement for introducing longitudinal waves in a deformable material web and a roller arrangement for compacting a material web featuring longitudinal waves.

Connections and transitions on buildings below concern roofing materials of any type placed on the roof, especially pantiles and roof tiles, as well as projecting building sections, such as, in particular, chimneys, windows, and dormers.

For connections and transitions on buildings, the problem arises that transition regions between different building parts must be sealed. This is the case, for example, for chimneys, skylights, or dormers. The construction of such a building part in the roof region prevents, for example, a continuous laying of the placed roofing tiles. Consequently, the area of the transition between the building part located above the roof and the roofing tiles bordering the building part must be sealed. The transition areas must be closed airtight and watertight.

Such sealing problems arise everywhere different layers or surfaces of components overlap each other or border each other. This is significant above all in the roof area, but generally plays an important role in the building trade. Typically, sealing strips are used that can be deformed plastically and can be adapted to the transition regions to be sealed. As an especially suitable sealing material that can be deformed plastically, deformable material webs featuring crepe folds have proven themselves.

The term "crepe folds" is understood primarily to be folds with a wavy profile in a creped form. For production of crepe folds, creping involves providing the deformable original material with folds that have significantly smaller lengths and widths relative to the material dimensions. The creping causes a shortening of the web in the direction perpendicular to the extent of the crepe folds and thus increased expandability of the creped product relative to the original material.

To be able to provide a sealing material for connections and transitions on buildings, wherein this sealing material can be deformed in a simple way in arbitrary directions, it is desirable to provide a correspondingly deformable material web in two dimensions, with crepe folds that run in at least two different directions.

Therefore, one task of the invention is to create an option for producing creped material that is provided with crepe folds in two dimensions, wherein the crepe folds run in different directions. Another task of the invention is to allow the continuous production of a creped material that is provided in two dimensions with crepe folds.

These tasks are achieved according to the invention with a method for producing a creped material, a roller arrangement for forming longitudinal waves, and a roller arrangement for compacting a material web featuring longitudinal waves according to the independent claims. Advantageous refinements form the subject matter of each associated subordinate claim.

The invention creates a method for producing a creped material, especially a sealing material for connections and transitions on buildings, wherein this sealing material is provided with crepe folds, with the steps:

a) preparing a deformable material web with a main expansion direction, b1) forming a longitudinal profile in at least one area of the deformable material web, wherein the longitudinal profile runs essentially parallel to the main expansion direction, c) forming a transverse profile in at least one area of the deformable material web, wherein the transverse profile runs at an angle not equal to 180°, especially essentially perpendicular, to the main expansion direction, d) pressing at least one section of the deformable material web, which has at least one area with a longitudinal profile and a transverse profile, wherein the material web is provided with crepe folds.

Thus, the invention offers, in a surprisingly simple way, the possibility of producing a creped material provided with crepe folds, wherein the crepe folds run in different directions and can also be formed over essentially the entire surface area of the material. In addition, with the method according to the invention the production of the creped material, provided in particular with crepe folds over the entire surface, can be advantageously performed continuously.

In a preferred refinement of the method according to the invention, after step b1) a step b2) compacting the longitudinal profile is performed. Therefore, the extra material supply that the material provides can be further increased.

To create extra material in a deformable and here essentially flat material, which can also be used easily in combination with profiled elements, for example, roofing tiles, the invention provides in a preferred configuration of the method to perform after step b2), a step b3) compressing the longitudinal profile.

The sequence of transverse and longitudinal profiling can obviously be interchanged within the scope of the invention, so that step b1), and/or b1) and b2), and/or b1), b2), and b3) are performed after step c).

The invention also offers the advantage of being able to produce the material provided over the entire surface with crepe folds in a continuous process, in which the material web is fed in the direction of its main expansion direction, especially continuously, during the execution of steps b1) to d). In a preferred refinement of the method according to the invention, it is provided that the forming of the longitudinal profile and/or the forming of the transverse profile and/or the pressing are performed continuously.

To be able to perform the continuous transfer of the deformable material web in the continuous production process for the sealing material, provided over the entire surface with crepe folds, between the individual processing steps, especially between forming the longitudinal waves and forming the transverse waves, essentially without build-up of the material, the invention creates the advantage of being able to maintain the advance of the web in its main expansion direction during the execution of the entire process. This is achieved in that according to an especially advantageous embodiment, the deformable material web is provided with waves from inboard to outboard when forming the longitudinal profile in step b1) or in steps b1) and b2).

The invention further offers the possibility of being able to process such materials as a deformable material web in which permanent shaping through deformation in the cold state (cold forming) cannot be performed. For this purpose, it is provided that the deformable material web be heated during formation of the longitudinal profile. In particular, in the scope of the method according to the invention, heating is performed to a temperature in the range between 50° C. and 200° C., preferably to a temperature in the range between 100° C. and 150° C. The temperature can be selected according to the material used for the deformable material web.

As the deformable material web, different materials can be used in order to be able to adapt the sealing material provided over the entire surface with crepe folds to different fields of use. In a preferred embodiment of the invention, a metal film, which contains, in particular, aluminum, is provided as the deformable material web. Especially suitable materials for the deformable material web include metals such as aluminum and/or zinc and/or copper and/or lead, as well as zinc-coated films and/or deformable plastics, as well as composite materials of such materials. For example, a metal film laminated with a plastic film can be provided as the deformable material web. Here, a metal film, which in particular comprises aluminum, can be used as the metal film.

The method according to the invention is performed such that the deformation of the material web in steps b1) to d) creates an extra material supply in the material web that allows re-shaping, after which the dimensions of the material web in the longitudinal direction and/or in the transverse direction are greater by at least 10%, advantageously by at least 30%, preferably up to 80%, relative to the dimensions that the material web would have reached in the longitudinal direction and/or in the transverse direction after step d). The expandability of the sealing material produced with the method according to the invention thus lies in the range between approximately 10% and approximately 80%.

This expandability is achieved especially in that the sealing material produced with the method according to the invention features crepe folds that run parallel and/or in different directions. Through the fine folds in the material, folding in any direction is then advantageously enabled, which can be realized easily by hand. This can be promoted even more by crepe folds with non-uniform constructions.

Another advantage of the sealing material produced with the method according to the invention lies in that it is made from only one layer and then all requirements can already be satisfied. The creping allows the simple, quick, and precise adaptation of the sealing material produced with the method according to the invention to differently structured surfaces of building parts on structures. Simultaneously, the sealing material according to the invention is especially well suited to the permanent formation of a deformed state, because it exhibits essentially no creeping behavior.

So that the formation of two types of crepe folds that run at an angle not equal to 180° to each other is possible in a continuously operable method for producing a sealing material provided over the entire surface with crepe folds, the invention further creates a roller arrangement for forming longitudinal waves in a deformable material web. The roller arrangement includes a first and a second roller, each with a rotational axis that can be rotatably supported and features a contact surface with a profile that is wave-like at least in some regions. The waves run along the circumferential direction of the contact surface. The contact surface includes a middle region to which side regions attach on each side. A middle line is defined by the outer boundary of the middle region viewed in the radial direction from the rotational axis. A side line is defined by the outer boundary of the side regions viewed in the radial direction from the rotational axis, wherein the middle line and the side line run parallel to the rotational axis, of the roller. For the first roller, the distance $\Delta M_1$ of the middle line to the rotational axis is greater than the distance $\Delta S_1$ of the side line to the rotational axis, and for the second roller, the distance $\Delta M_2$ of the middle line to the rotational axis is smaller than the distance $\Delta S_2$ of the side line to the rotational axis, so that the middle region of the first roller defines at least one projection and the middle region of the second roller forms at least one receptacle for the projection of the first roller, when the two rollers roll one on the other with their contact surfaces during operation.

The roller arrangement according to the invention allows the execution of step b1) forming a longitudinal profile in at least one region of the deformable material web, wherein the longitudinal profile runs essentially parallel to the main expansion direction within the scope of the method according to the invention.

The term "longitudinal waves" is here understood to be waves that have wave crests and valleys extending along the main expansion direction of the web. The main expansion direction is here simultaneously, in particular, the advancing direction in which the web is advanced by the roller arrangement.

In a preferred construction of the roller arrangement according to the invention for forming longitudinal waves in a deformable material web, the first and the second rollers are constructed so that the wave crests and valleys of the wave-shaped profile have an essentially semicircular cross section. Through the associated symmetry, the production of the corresponding profiles of the contact surfaces of the rollers is advantageously simplified.

In one refinement of the roller arrangement according to the invention for forming longitudinal waves in a deformable material web, corresponding profiles of the contact surfaces of the rollers are realized in a simple way, such that the side regions of the first roller include a wave valley and a wave crest with the wave valley connecting to the middle region, and the side regions of the second roller include a wave crest connecting to the middle region, so that the wave valley in the side region of the first roller forms a receptacle for the wave crest in the side region of the second roller.

To be able to insert several such roller arrangements, staged one behind the other, in order to form longitudinal waves connecting to each other in intermediate regions from inboard to outboard over the width of the deformable material web, essentially without non-deformed intermediate regions, it is advantageous for the region that connects to the side region of the web deformed at least into a longitudinal wave, and that is to be deformed in the following roller arrangement, to enter as smoothly as possible, and unaffected by the preceding roller arrangement, into the next roller arrangement.

For this purpose, the invention provides, in a preferred construction of the roller arrangement for forming longitudinal waves in a deformable material web, that the side regions of the second roller include a cylindrical region, connecting to the wave crest, whose outer surface extends parallel to the rotational axis, so that in the operation of the roller arrangement, the wave crest in the side region of the first roller can roll on the cylindrical region in the side region of the second roller.

To be able to generate a uniform profile of the longitudinal waves, in one advantageous embodiment of the invention the roller arrangement for forming longitudinal waves in a deformable material web is shaped such that the wave crests, wave valleys, and cylindrical regions have essentially the same width measured parallel to the rotational axis of the roller.

The width of the wave crests, wave valleys, and cylindrical regions is here, in particular, less than approximately 2 cm, and lies preferably in the range of approximately 0.1 cm to approximately 1 cm, especially preferably at approximately 0.5 cm. The first and the second roller of the roller arrangement for forming longitudinal waves in a deformable material web can have, for example, a width measured parallel to the rotational axis less than approximately 10 cm, preferably in the range of approximately 0.5 cm to approximately 5 cm, especially preferably approximately 2 cm. Here, the rollers can in particular have a diameter, measured at the greatest extent perpendicular to the rotational axis, of less than approximately 20 cm, preferably in the range of approximately 1 cm to approximately 10 cm.

The size, especially the diameter, the thickness, or the dimension of the profile of the rollers determines the penetration depth in the deformation of the material web. According to the invention, the corresponding dimensions are selected so that the desired expandability is established by means of the deformation. The distance between the middle line and the side line is, in a preferred construction of the roller arrangement according to the invention, less than approximately 2 cm and lies preferably in the range of approximately 0.1 cm to approximately 1 cm, especially preferably at approximately 0.5 cm. The radius of the semicircles formed in an advantageous embodiment of the invention by the wave crests and wave valleys of the wave profile with a semicircular cross section is, in particular, less than approximately 2 cm, and lies preferably in the range from approximately 0.1 cm to approximately 1 cm, especially preferably at approximately 0.5 cm.

To allow the execution of the step b2) compacting the longitudinal profile of the method according to the invention, especially in continuous operation or in combination with a roller arrangement for forming longitudinal waves in a deformable material web as is described above, the invention also creates a roller arrangement for compacting a material web featuring longitudinal waves. This roller arrangement for compacting a material web featuring longitudinal waves includes a first and a second roller, each with a rotational axis, which can be rotatably supported and which include a profiled peripheral surface. The first and the second roller each have an enveloping surface that encloses the profiled peripheral surface and which is the outer surface of a cylinder about the rotational axis of the first or the second roller, wherein, the enveloping surface of the first roller essentially rolls on the enveloping surface of the second roller during operation of the roller arrangement.

The regions of the deformable material web that are not deformed or not yet deformed and that are located beside the already deformed region are guided by the arrangement of the two rollers relative to each other and the shaping with the corresponding enveloping surfaces in an essentially flat surface between the two rollers. Through contact with the profiled peripheral surface of the rollers, the longitudinal profile is flattened when passing through the roller arrangement for compacting a material web featuring longitudinal waves. Here, in cross section, a Ω-shaped profile of the deformable material web is created.

In a preferred refinement of the roller arrangement for compacting a material web featuring longitudinal waves, the rollers include a middle region that is cylindrical with respect to the rotational axis. Side regions with surfaces running at an angle not equal to 180°, especially at an angle of 45°, to the outer surface of the cylindrical, middle region connect to this middle region on both sides, wherein the side regions of a roller define projections relative to the cylindrical middle region, and the side regions of the other roller are cut back in the direction of the rotational axis relative to the cylindrical middle region.

In particular, the surface of a side region on the first roller runs parallel to the surface of a corresponding side region on the second roller, so that a gap is formed between the rollers that has an essentially constant width. In a preferred embodiment of the roller arrangement for compacting a material web featuring longitudinal waves, the middle region of a roller has a central region that includes a recess for holding at least one part of a wave in the material web featuring longitudinal waves so that the convexity of the Ω-shaped profile is formed when passing the material web featuring longitudinal waves through the roller arrangement for compacting a material web featuring longitudinal waves.

The rollers of the roller arrangement for compacting a material web featuring longitudinal waves can have, for example, a width measured parallel to the rotational axis less than approximately 10 cm, preferably in the range of approximately 0.5 cm to approximately 4 cm, especially preferably of approximately 1.7 cm. In particular, the rollers have a diameter measured at the greatest extent perpendicular to the rotational axis of less than approximately 20 cm, preferably a diameter in the range of approximately 1 cm to approximately 7 cm, especially preferably of approximately 3.5 cm.

The width of the side regions of the rollers of the roller arrangement for compacting a material web featuring longitudinal waves is, in a preferred embodiment of the invention, less than approximately 1 cm and lies preferably in the range of approximately 0.05 cm to approximately 0.5 cm, especially preferably at approximately 0.25 cm. The width of the central region can be, in a refinement of the roller arrangement according to the invention for compacting a material web featuring longitudinal waves, less than approximately 4 cm and lies preferably in a range of approximately 0.1 cm to approximately 4 cm.

The recess advantageously has a circular arc-shaped cross section, in particular, an essentially semicircular cross section. The radius of the circular arc, especially the semicircle, which forms the recess with a circular arc-shaped, in particular, a semicircular cross section, is in particular less than approximately 2 cm, and lies preferably in the range of approximately 0.1 cm to approximately 1 cm, especially preferably at approximately 0.5 cm.

The invention further provides a tandem roller arrangement that combines a roller arrangement for forming longitudinal waves in a deformable material web and a roller arrangement for compacting a material web featuring longitudinal waves, wherein the two roller arrangements are arranged in alignment one behind the other with reference to the advancing direction, in which during operation a deformable material web is fed through the tandem roller arrangement such that during operation, the longitudinal wave formed in the roller arrangement runs in the roller arrangement through the profiled peripheral surfaces.

The invention further provides a device for use during the continuous production of a creped material that includes several roller arrangements for forming longitudinal waves in a deformable material web that are arranged along a feeding direction of a deformable material web running through the device during operation.

In another embodiment of the invention, a device is presented that includes several roller arrangements for compacting a deformable material web featuring longitudinal waves arranged along a feed direction of a deformable material web running through the device during operation. Likewise, the invention presents a device for use during continuous production of a creped material that includes several tandem roller arrangements arranged along a feeding direction of a deformable material web running through the device during operation. The alignment of the individual roller arrangements or tandem roller arrangements relative to each other in the devices is oriented according to the desired goal of the processing of the deformable material web in the corresponding device. If longitudinal waves are to be formed from inboard to outboard in the deformable material web, the invention provides that in the device for use during continuous production of a creped material, the roller arrangements or the tandem roller arrangements are arranged essentially in a V shape, and/or essentially in a U shape, relative to each other.

For example, the device according to the invention can include at least three roller arrangements for forming longitudinal waves in a deformable material web, wherein the roller arrangements are positioned in a V or U shape relative to each other. The invention likewise provides a device for use during continuous production of a creped material that includes at least three roller arrangements for compacting a material web featuring longitudinal waves, wherein the roller arrangements are positioned in a V or U shape relative to each other.

The V-shaped or U-shaped or similarly shaped arrangement is here aligned preferably mirror symmetric to the feeding direction of the deformable material web through the device, so that forming or compacting longitudinal waves is possible from inboard to outboard with respect to the deformable material web.

If longitudinal waves are formed from one side edge of the material web to the other side edge, the invention provides in another embodiment that the roller arrangements or the tandem roller arrangements be arranged on a line that runs at an angle to the feeding direction.

In one preferred refinement, the invention provides a device for use during continuous production of a creped material that includes at least three roller arrangements for forming longitudinal waves in a deformable material web and at least three roller arrangements for compacting a material web featuring longitudinal waves, wherein a roller arrangement for forming longitudinal waves in a deformable material web and a roller arrangement for compacting a material web featuring longitudinal waves form a tandem roller arrangement and the three or more tandem roller arrangements are positioned in a V shape relative to each other. The invention thus also provides a device for the continuous production of a creped material that includes at least one device for continuously feeding a deformable material at least one device for continuously forming a longitudinal profile in the deformable material, as was described above, a device for continuously pressing the material for producing a material with pressed longitudinal waves, and a device for continuously discharging the material with pressed longitudinal waves.

The invention shall also create a sealing material that is used to seal connections and transitions, especially between building parts on the roof, wherein on the one hand this sealing can be performed easily and quickly by the worker, and on the other hand a consistently good and reproducible quality of the seal can be achieved.

This task is achieved by a sealing material for use for connections and/or transitions of parts on buildings, especially in the roof area, which is characterized in that it is provided in two dimensions with crepe folds.

The structure of the sealing material is here designed so that the creping creates extra material that makes the sealing strip expandable. The expandability lies approximately in the range of 10% to 80%.

Another advantage of the sealing material according to the invention lies in that it is made from only one layer and can already satisfy all of the requirements. In particular, the invention allows the elimination of a carrier material made from an expanded metal lattice insert. This is associated with clear advantages relative to known sealing materials with respect to the economic efficiency of production, the price of the product, and the workability of the sealing material.

The sealing material can be constructed such that the crepe folds run parallel and/or in different directions.

By means of the fine folds in the material, a fold in any direction is then advantageously permitted, which can be performed easily by hand. This can be promoted even more in that the crepe folds have a non-uniform construction. The sealing material according to the invention can be made from very different materials and thus can be adapted to many different requirements. In particular, deformable plastics, metals, especially aluminum, zinc, and/or copper, as well as lead, and/or zinc-coated films can be used.

The sealing material can have an adhesive coating on its bottom side.

In particular, high flexibility of the adhesive element attached to the bottom side is provided so that the sealing material can be pulled around corners and edges without requiring the use of additional folding machines. Thus a sound and qualitatively high-grade seal can also be achieved for transitions that are difficult to seal.

Instead of an adhesive coating, an insulating layer can also be deposited on the bottom side of the sealing material in order to simultaneously permit heat insulation.

The sealing material is further characterized in that a coating is provided on its top side. The coating can contain, in particular, a paint. By coating the sealing material, the possibility is in particular provided of matching different colorings of the roof.

The coating can also be weather-resistant and/or impermeable to UV, so that the sealing material withstands a wide range of stresses for a long time.

The invention also relates to a roof ridge and arris ventilation element that is characterized in that it features a sealing material described above.

The advantages of the sealing material with respect to simple handling for very good sealing behavior, long-lasting sealing, and especially economic production can also be used according to the invention in a roof ridge and arris ventilation element.

Here, first, the sealing material can be used exclusively for the construction of the roof ridge and arris ventilation element. For this purpose, the sealing material is made available in a strip that can be provided in a middle region of the roof ridge and arris ventilation element with ventilation holes. Second, side parts made from the sealing material can be attached to a middle part that is permeable to air but impermeable to rain and falling snow. In each case, the air-permeable middle part can be placed on the roof ridge or on the arris and the side parts can be molded to the adjacent roofing tiles in order to create a sealed transition from the roof ridge or an arris to the tiles.

Figure 2:
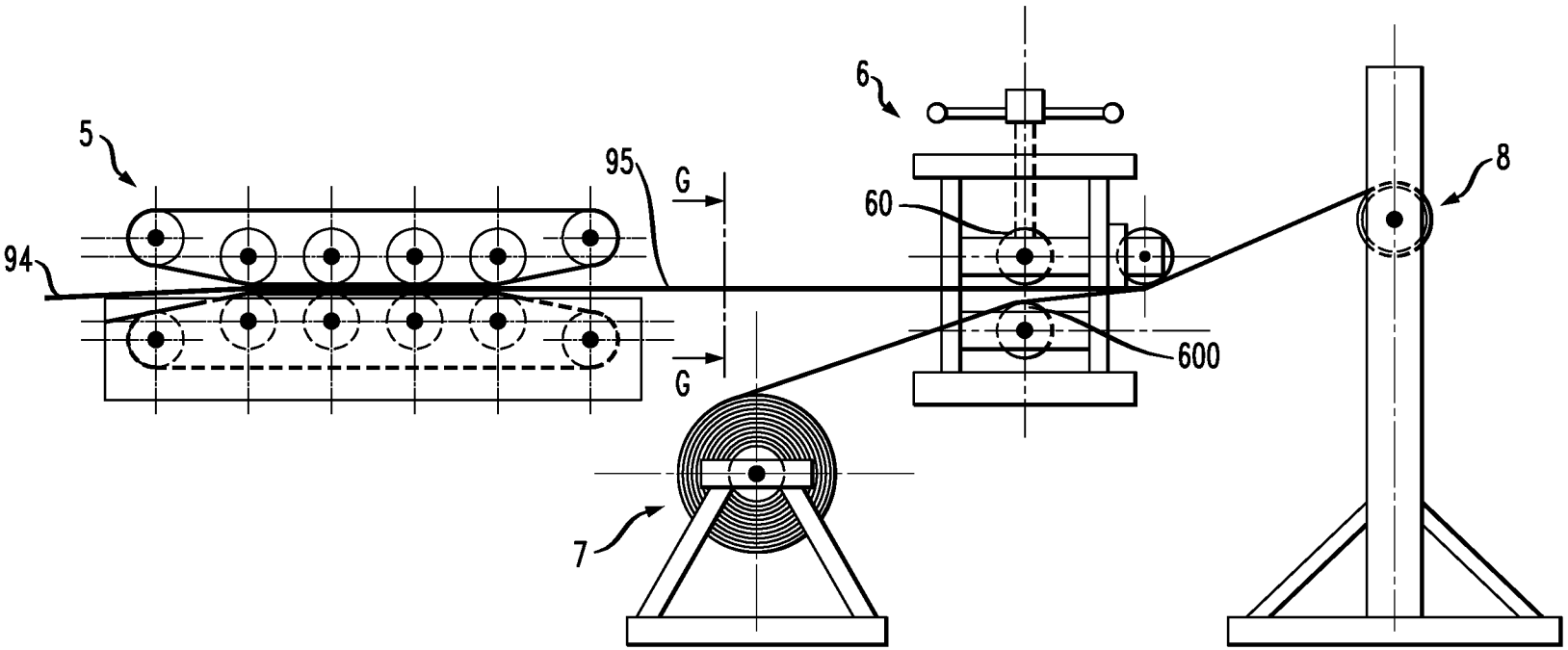
Figure 3:
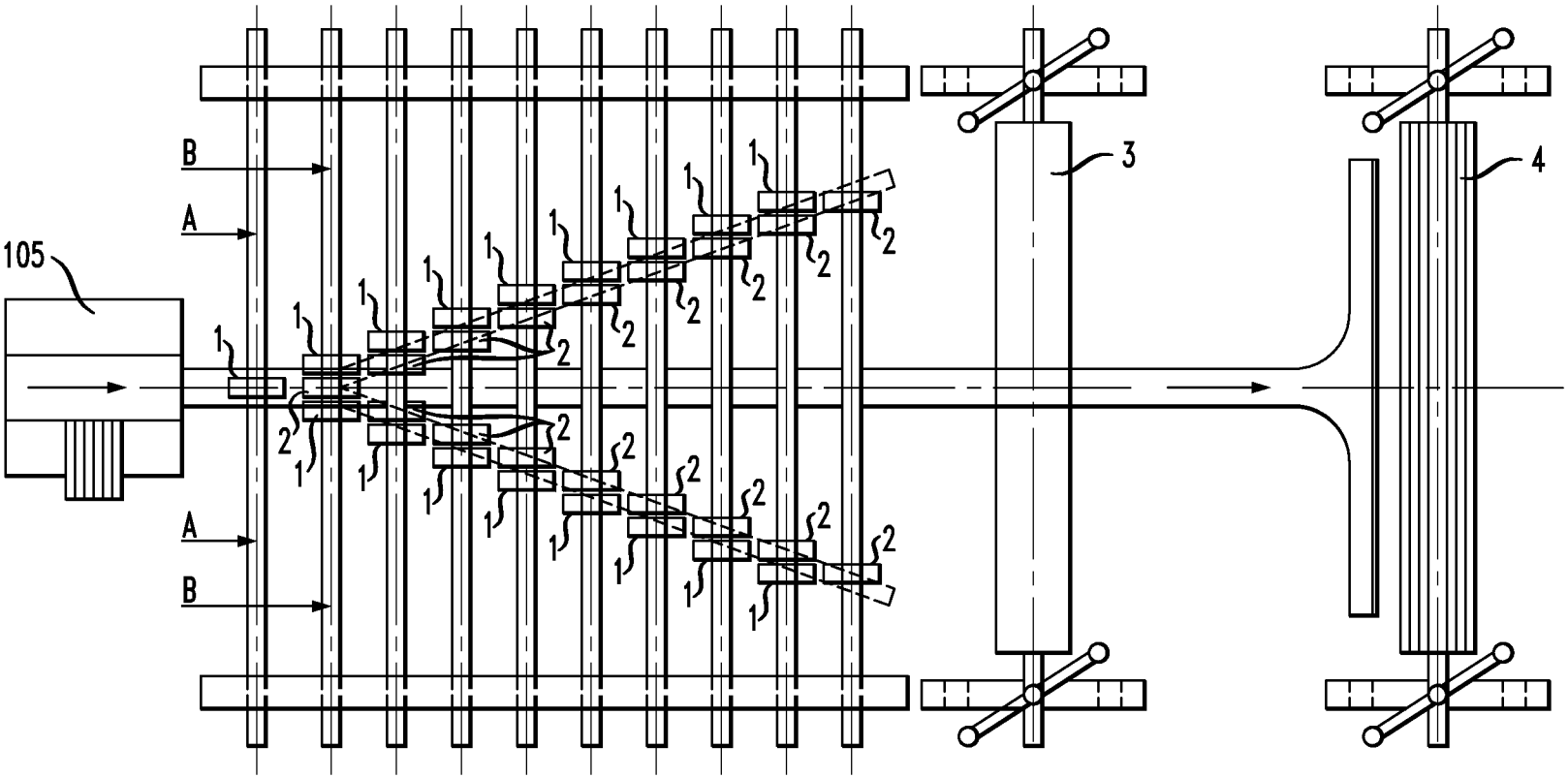
Figure 4:
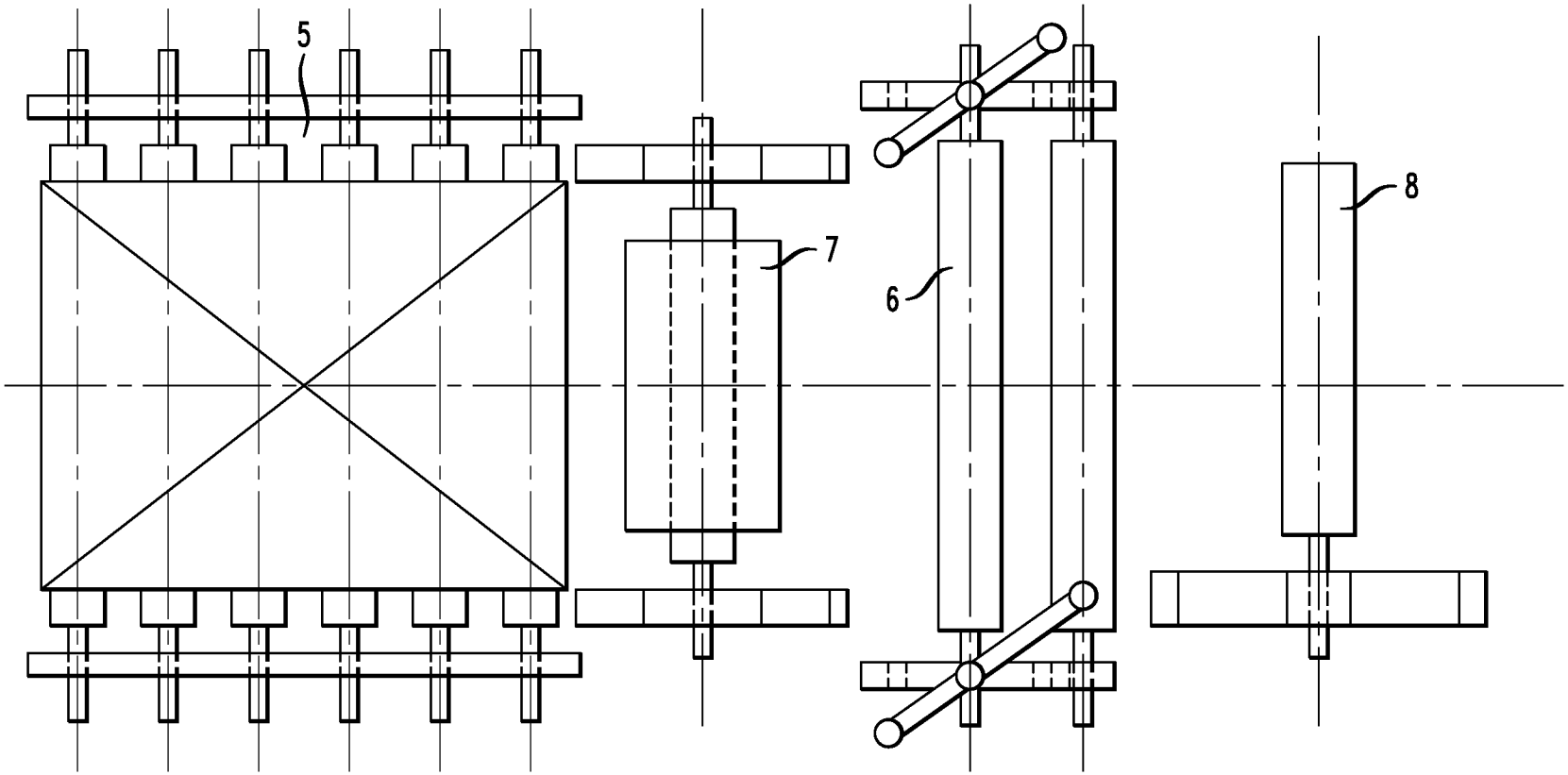
Figure 5:
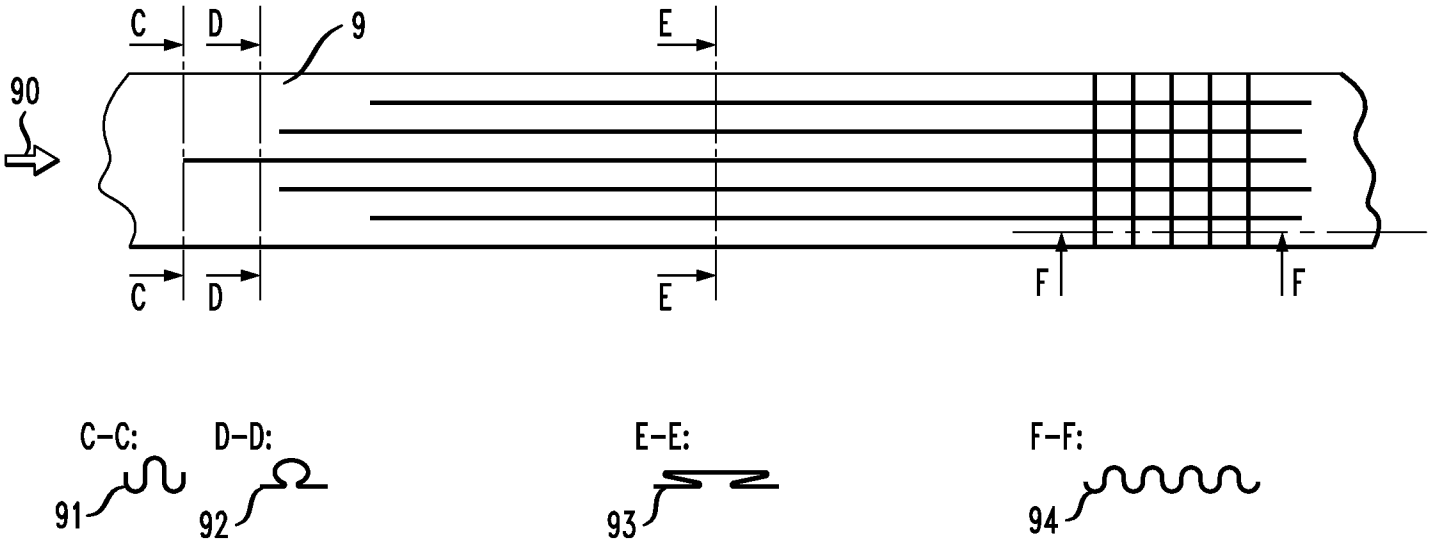
Figure 6:
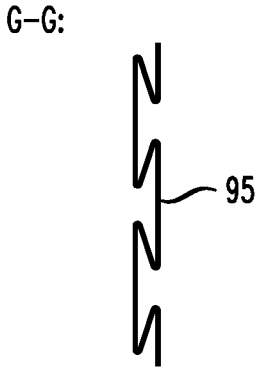
Figure 7:
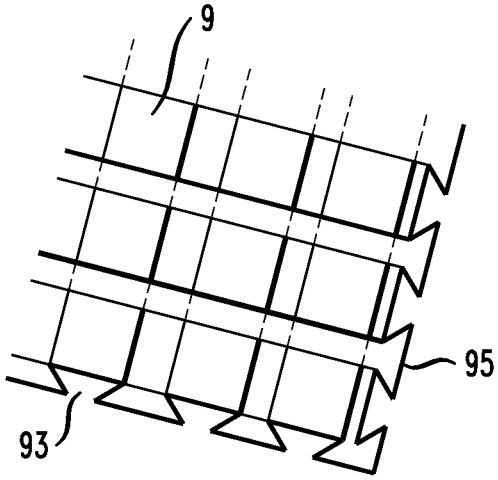
Figure 8A:
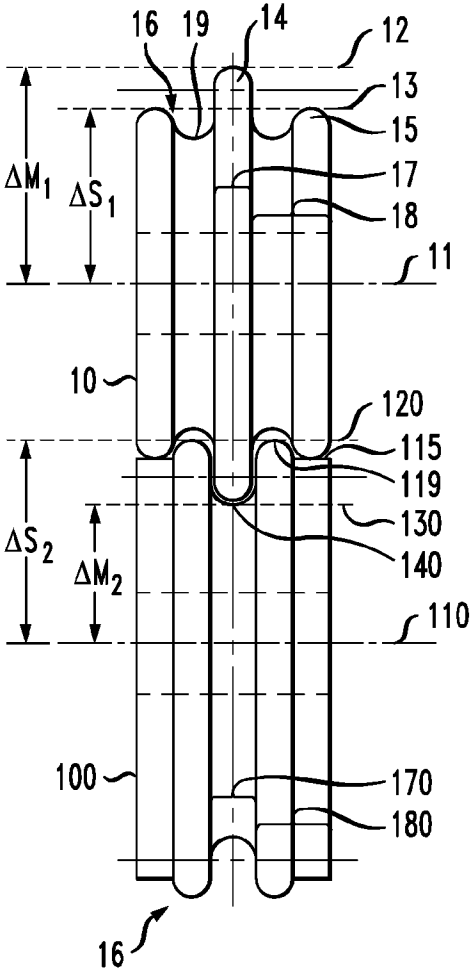
Figure 8B:
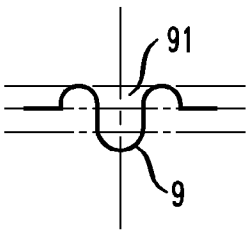
Figure 8C:
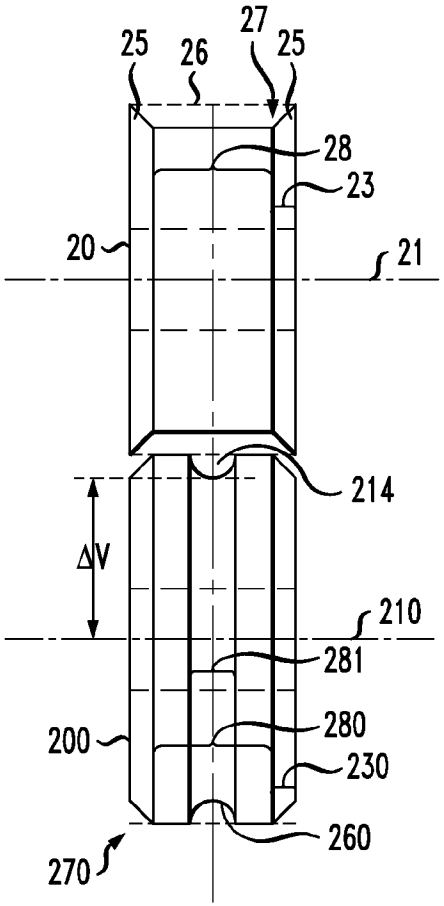
Figure 8D:
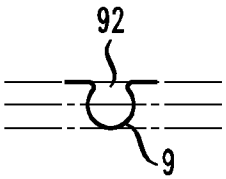

The invention will be explained in more detail below with reference to the enclosed drawings with reference to embodiments. The same components are provided with the same reference symbols in all of the figures. Shown are:

FIG. 1 a side view of a device for performing the steps a) to c1) of the method according to the invention, FIG. 2 a side view of a device for performing the method according to the invention starting with step d), FIG. 3 a top view onto a device for performing the method according to the invention with the steps a) to c1), FIG. 4 a top view onto a device for performing the method according to the invention starting with step d), FIG. 5 a schematic representation of a deformable material web 9 in top view, which was taken from the device shown in FIGS. 1 and 3 after performing step c1) of the method according to the invention, FIG. 6 a schematic representation of a cross section of a deformable material web, which was taken from the device shown in FIGS. 2 and 4 after performing step d) of the method according to the invention, FIG. 7 a schematic representation of a creped material that is provided over its entire surface with crepe folds, in perspective representation, FIG. 8A a schematic representation of a roller arrangement for a device for performing the method according to the invention along the section A-A according to the representation in FIGS. 1 and 3, FIG. 8B a schematic representation of a deformable material web after passing through the roller arrangement shown in FIG. 8A, FIG. 8C a schematic representation of a roller arrangement for a device for performing the method according to the invention in a view from the direction B-B according to the representation in FIGS. 1 and 3, FIG. 8D a schematic representation of a deformable material web after passing through the roller arrangement shown in FIG. 8C, FIG. 9A a schematic representation of a roller arrangement for a device for performing the method according to the invention in a view from the direction C-C according to the representation in FIGS. 1 and 3, FIG. 9B a schematic representation of a deformable material web after passing through the roller arrangement shown in FIG. 9A, FIG. 10 a schematic representation of a seal between the chimney connection element and roofing tiles with the sealing material.

In FIGS. 1 and 2, as well as in FIGS. 3 and 4, an overall view of the individual processing steps is shown while performing the method according to the invention. FIGS. 1 and 2 show the corresponding devices in side view and FIGS. 3 and 4 show the associated top view.

At the beginning of the method, a deformable material web 9 is fed to the device 102. The deformable material web 9 has a main expansion direction 90. In the shown embodiment of the invention, the deformable material web 9 is fed continuously in its main expansion direction 90 during the execution of the method according to the invention. The main expansion direction is thus the same as the feeding direction of the web.

Aluminum foil can be used, for example, as the deformable material web. In a preferred construction, an aluminum foil laminated with plastic film can be used as the deformable material web. The deformable material web 9 is made wavy while passing through the device 102 by means of individual rolls from inboard to outboard in their longitudinal direction, that is, in the main expansion direction 90. In FIGS. 8A, 8C, and 9A, the individual rollers are shown that are used in the individual steps of forming longitudinal waves to form creped material in the longitudinal direction.

When passing through the device 102, the deformable material web 9 is heated in the shown embodiment. For this purpose, a hot-air supply 105 provides heated air directed onto the deformable material web 9 when forming longitudinal waves as well as when forming transverse waves. The supply of hot air for heating the deformable material can be realized, according to which materials are selected for the web 9, from below and/or from above when forming the longitudinal waves or the transverse waves. The heating increases the temperature of the deformable material web to values between, for example, 100 and 150° C.

By supplying heat, material webs 9 can also be deformed in a simple way that exhibit a large restoring ability, so that cold forming is not possible. Heating to temperatures between 100 and 150° C. is advantageous especially for the use of aluminum foil laminated with a plastic film as the deformable material web 9. A fan with a motor and heater can be used as the hot-air supply 105, for example.

The device 102 includes a device 101 with seventeen roller arrangements 1 in the shown example for forming longitudinal waves and a device 102 with seventeen roller arrangements 2 in the shown example for compacting the longitudinal waves, wherein a roller arrangement 1 for forming longitudinal waves and a roller arrangement 2 for compacting longitudinal waves are arranged one behind the other in the main expansion direction 90 of the deformable material 9 and form a tandem roller arrangement. The tandem roller arrangements as well as the roller arrangements 1 and the roller arrangements 2 are positioned in a V shape relative to each other in the shown embodiment. The V-shaped positioning of the tandem roller arrangements is especially easy to see in the top view (see FIG. 3) of the device 102.

When passing through the roller arrangement 1, the deformable material web 9 is provided with longitudinal waves 91 extending parallel to the main expansion direction 90. In FIG. 5, the deformable material web 9 is shown in top view while passing through the device shown in FIGS. 1 and 3. In addition, cutouts from a view in cross section are shown, which illustrate the various processing stages of the deformable material web.

After passing through the roller arrangement 1, the deformable material web 9 is provided with longitudinal waves 91 extending parallel to the main expansion direction 90 of the deformable material web 9. When passing through the roller arrangement 2, the longitudinal waves 91 are compacted, so that a Ω-shaped profile 92 is produced. After the deformable material web 9 has been provided essentially over its entire width with longitudinal waves 91 that have been compacted to form the Ω-shaped profile 92 in the device 102, the web with the profile 92 enters into the first press machine 3.

In the first press machine 3, the web 9 passes through a gap between rubber-coated rollers 30 and 300, wherein the embossing 92 is deformed and the material is pleated. A profile of flat-pressed longitudinal waves 93 is produced. The web provided in this way with crepe folds in the longitudinal direction enters with the profile 93 into a second press machine 4. In the second press machine 4, a transverse pleating is impressed in the deformable material web 9. Here, the deformable material web is in the shown embodiment provided with transverse waves 94 essentially perpendicular to its main expansion direction.

Because in the first press machine 3 the compacted longitudinal waves 92 were deformed to form a zigzag fold 93 and the entire material was pleated in another processing step in the second press machine 4 by pleating rollers 40 and 400 and therefore was made wavy in the transverse direction, the material 94 with transverse waves is again compressed in a heavy rolling machine 5, so that a creped material 95 is obtained with compressed transverse pleating.

The heavy rolling machine 5 involves a device for continuous pressing of at least one section of at least one profiled web with a pressing device featuring a press gap of predetermined width and length and tapering in the feeding direction of the web 9 to be pressed, as well as at least one surrounding press band that can circulate about two rollers. Such a device is the subject matter of the German Patent No. DE 102 41 230 by the applicant. After folding the film 9 in the devices 102, 3, 4, and 5, approximately 80% of extra material is produced in the longitudinal as well as also in the transverse direction in the shown embodiment.

In another processing step, the creped material 95 is provided with an adhesive layer in a third press machine 6. For this purpose, a butyl band is deposited from below over all or part of the surface onto the material, for example, onto the folded aluminum foil 9. The butyl band can be covered with a cover film. For depositing the butyl band a butyl supply 7 is provided, from which the butyl band is fed into the third press machine 6 for depositing butyl. By compressing the creped material 95 with the butyl band between the rollers 60 and 600, the creped material is connected to the butyl band. The completed product is then wound on a winding machine 8 to form so-called endless rolls. For example, rolls can be produced on which a creped material with a length of 5 m is rolled.

To be able to produce a creped material that is provided over its entire surface with crepe folds that are not parallel to each other, a deformable material 9 is profiled as described above in at least two directions, for example, in the longitudinal direction and in the transverse direction. The profiling in the transverse direction is possible in a relatively simple way under the use of two profiling rollers in the second press machine 4. However, to be able to perform the method for producing a creped material that is continuously provided over its entire surface with crepe folds in the longitudinal and transverse direction, the longitudinal profiling is performed parallel to the feed direction of the web 9 in order to be able to feed the longitudinally profiled web in a later processing step of the transverse profiling. In another embodiment of the invention, the transverse profiling is performed in a first processing step and then the longitudinal profiling.

Within the scope of the invention, the total feed rate with which the deformable material 9 is introduced into the device 102, led through the device 102, and guided through the first press machine 3 and the second press machine 4, as well as through the heavy rolling machine 5 and the third press machine 6 up to the winding roller 8 is constant. This means that the speeds of the rollers 10, 100, 20, 200, 30, 300, 40, 400, the feed means, the heavy rolling machine, and also the rollers 60 and 600, the butyl feed 7, and the winding roller 8 are adjusted relative to each other.

A roller arrangement 1 is provided for the continuous formation of longitudinal waves 91 in the deformable material web 9. Such a roller arrangement is shown schematically in FIG. 8A. The roller arrangement 1 includes a first roller 10 and a second roller 100. The first roller 10 has a profiled contact surface 16 and can be supported so that it can rotate about a rotational axis 11. The second roller 20 has a profiled contact surface 160 and can be supported so that it can rotate about a rotational axis 110.

The first roller 10 includes a middle region 17, with side regions 18 connecting to this middle region on the right and left. The contact surface 16 has a wavy profile, wherein the waves run along the circumferential direction of the contact surface 16. The outer boundary of the middle region 17 viewed in the radial direction from the rotational axis 11 defines a middle line 12 of the first roller 10. The outer boundary of the side regions 18 viewed in the radial direction from the rotational axis 11 defines a side line 13. Between the middle line 12 and the rotational axis 11 there is a distance $\Delta M_1$ for the first roller 10. There is a distance $\Delta S_1$ for the first roller 10 between the side line 13 and the rotational axis 11.

The side regions 18 of the first roller 10 include a wave valley 19 and a wave crest 15, with the wave valley 19 connecting to the middle region 17. In the middle region 17, the first roller 10 has a projection 14. The distance $\Delta M_1$ is greater than the distance $\Delta S_1$, so that the difference of the distances $\Delta M_1$ and $\Delta S_1$ defines the height of the projection 14.

The second roller 100 has a middle region 170, with side regions 180 connecting to both sides of this middle region. A middle line 120 is defined by an outer boundary of the middle region 170 viewed in the radial direction from the rotational axis 110. Between the middle line 120 and the rotational axis 110 of the second roller 100 there is a distance $\Delta\delta S_2$. A side line 130 is defined by the outer boundary of the side regions 180 viewed in the radial direction from the rotational axis 110. Between the side line 130 and the rotational axis 110 there is a distance $\Delta M_2$.

The second roller 100 includes, in its side regions 180, a wave crest 119 and a cylindrical region 115, wherein the wave crest 119 connects to the middle region 170. The middle region 170 has a recess. The distance $\Delta S_2$ is greater than the distance $\Delta M_2$, so that the difference of the distances defines the depth of the recess in the middle region 170.

In the shown embodiment, the height of the projection 14 of the first roller 10 is essentially equal to the depth of the recess in the second roller 100, so that the recess in the middle region 170 of the second roller 100 forms a receptacle 114 for the projection 14 of the first roller when, during operation of the roller arrangement 1, the profiled contact surfaces 16 of the first roller 10 and 160 of the second roller 100 engage each other and roll on each other.

In the shown embodiment of the invention, the wave crests 14, 15, and 119, as well as the wave valleys 19 and 114 of the roller arrangement 1 have an essentially semicircular cross section. The profile 91 produced when the deformable material web 9 passes through the roller arrangement 1 is shown in FIG. 8B at the same scale as the roller arrangement 1 shown in FIG. 8A.

To provide the greatest possible extra material in the creped material during the production of a creped material according to the invention, this longitudinal profile is flattened, in order to obtain a Ω-shaped profile from the wavy profile as shown in FIG. 8B, before compressing the longitudinal profile 91. The roller arrangement 2 for compacting the longitudinal waves 91 is shown schematically in FIG. 8C.

The roller arrangement 2 for compacting longitudinal waves includes a first roller 20 and a second roller 200. The first roller 20 has a profiled peripheral surface 27 and can be supported so that it can rotate about a rotational axis 21. The profiled peripheral surface 27 is enclosed by an enveloping surface 26, which is the outer surface of a cylinder about the rotational axis 21 of the first roller 20 that contacts the profiled peripheral surface 27 at its point farthest removed from the rotational axis 21 in the radial direction. The second roller 200 has a profiled peripheral surface 270 and can be supported so that it can rotate about a rotational axis 210. The second roller 200 has an enveloping surface 260, which encloses the profiled peripheral surface 270. The enveloping surface 260 is an outer surface of a cylinder about the rotational axis 210 of the second roller 200 that contacts the profiled peripheral surface 270 at its point farthest removed from the rotational axis 210 in the radial direction.

During the operation of the roller arrangement 2, the enveloping surface 26 of the first roller 20 rolls on the enveloping surface 260 of the second roller 200. The profiled peripheral surfaces 27 and 270 of the first roller 20 or the second roller 200 are here shaped so that a continuous gap is defined between the rollers of the roller arrangement 2 for compacting longitudinal waves.

The first roller 20 includes a middle region 28, wherein side regions 23 connect to both sides of this middle region. The second roller 200 includes a middle region 280, wherein side regions 230 connect to both sides of this middle region. The middle region 28 of the first roller 20 has a cylindrical shape with reference to the rotational axis 21. The middle region 280 of the second roller 200 is arranged adjacent to the middle region 28 of the first roller.

The middle region 280 of the second roller 200 includes a central region 281. A recess 214 is formed in the central region 281. A distance ΔV between the deepest point of the recess 214 and the rotational axis 210 is defined by the inner boundary of the recess 214 viewed from the rotational axis 210 in the radial direction. The distance ΔV is greater than the distance $\Delta M_2$ in the second roller 100 of the roller arrangement 1 for forming longitudinal waves 91.

The roller arrangement 1 and the roller arrangement 2 form a tandem roller arrangement. In a tandem roller arrangement according to the invention, the two roller arrangements 1, 2 are arranged in alignment one behind the other with reference to the main expansion direction of the deformable material web, that is, the feeding direction 90, such that during operation the longitudinal wave 91 formed in the roller arrangement 1 on the projection 140 is fed into the roller arrangement 2 by the profiled peripheral surfaces 27, 270, especially by the recess 214.

If the deformable material 9 provided with longitudinal waves 91 passes through the roller arrangement 2 for compacting longitudinal waves, the wave section formed between the receptacle 114 and the projection 14 in the roller arrangement 1 for forming longitudinal waves 91 is fed through the recess 214, wherein the wavy regions adjacent to this wave section contact the cylindrical peripheral surface of the middle region 28 of the first roller 20 of the roller arrangement 2 for compacting longitudinal waves. Here, the wavy profile 91 is flattened, such that a Ω-shaped profile with compacted longitudinal waves 92 is produced by the gap between the first roller 20 and the second roller 200.

For pressing the compacted longitudinal profile 92 and thus for completing the longitudinal pleating, the material 9 with the compacted longitudinal waves 92 is fed to the first press machine 3. As shown in FIG. 9A, the first press machine 3 includes a first roll 30 and a second roll 300, which can be supported so that they can rotate spaced apart from each other. When passing through the gap between the rollers 30 and 300 of the first press machine 3, the compacted longitudinal profile 92 is pressed, so that a pressed longitudinal profile 93 is produced, as shown in FIG. 9B, corresponding to the dimensions of the first press machine 3 shown in FIG. 9A.

The material produced or creped according to the invention can be used either directly or can also be further processed to form a sealing strip. Such a sealing strip includes a sealing material that has an adhesive coating on its bottom side. This coating can be, for example, a butyl band. The sealing material is provided over its entire surface with crepe folds. The crepe folds can be arranged non-uniformly, so that the material can be easily pulled out in all directions.

The sealing material can be constructed, for example, as an aluminum band whose one side has a colored, protective coating and whose other side is laminated against a PET film.

The layer construction includes 8.0±1.7 g/m$^2$ protective paint, for example, brick-red protective paint (acryl base). In addition, the layer construction includes an aluminum band with a thickness of 70.0±5.6 μm, a paint lamination of 3.0±0.9 g/m$^2$, and a PET film with a thickness of 23±2.3 μm. The bond strength between aluminum and PET film equals more than 5 N/15 mm. This indication means that a strip 15 mm wide is subjected to a force of 5 N up to tearing.

The aluminum material has, according to DIN EN 573-3, the material composition AA 8021(B) (=AlFe1.5). Its technological values are

| | |
|---|---|
| state 01 soft | |
| tensile strength $R_m$ | 80 to 140 MPa, especially 134.1 MPa |
| apparent yield point $R_{p0.2}$ | 35 to 65 MPa, especially 56.3 MPa |
| elongation at rupture $A_{1\ 100}$ | greater than or equal to 11%, especially 21.5%. |

The indication $A_{1\ 100}$ signifies that a 100 mm-long material sample is used for the elongation at rupture test.

For the application according to the invention, the composite material described above is deformed mechanically, in that it is set in waves, in order to form creping.

In FIG. 10, sealing of a chimney 29 relative to the adjacent roofing tiles 31 with a sealing strip 111 is shown. The sealing strip 111 is molded in one region 161 flat on the surface of the chimney 29 and is connected to the chimney 29. In the regions 171 and 181, the sealing strip 111 is molded onto the surface of the roofing tiles 31 and forms a sealed transition between the chimney 29 and the roofing tiles 31.

In a region 171, the sealing strip 111 is molded in a direction perpendicular to the roof ridge onto the roofing tiles. In a region 181, the sealing strip 111 is molded exactly perpendicular to this onto the roofing tiles. The region 191 forms the transition between the regions 171 and 181. It becomes clear that the sealing material can be adapted in any direction to surface contours, because can easily fold, extend, and deform in all directions.

The sealing strip 111 forms, in the embodiment described above, a chimney connection element. In a corresponding way, the sealing strip can also be used on windows, dormers, and other transitions on buildings. In particular, the sealing material can also be used for the incorporation of pipes.

It is clear to someone skilled in the art that the invention is not limited to the previously described embodiments, but instead can be varied in various ways. In particular, the features of the individual embodiments can also be combined with each other.

List of reference symbols

| | |
|---|---|
| 1 | Roller arrangement for forming longitudinal waves |
| 10 | First roller |
| 11 | Rotational axis |
| 12 | Middle line |
| 13 | Side line |
| 14 | Projection |
| 15 | Wave crest |
| 16 | Running surface |
| 17 | Middle region |
| 18 | Side region |
| 19 | Wave valley |
| 100 | Second roller |
| 110 | Rotational axis |
| 119 | Wave crest |
| 120 | Middle line |
| 130 | Side line |
| 114 | Receptacle |
| 115 | Cylindrical region |
| 160 | Running surface |
| 170 | Middle region |
| 180 | Side region |
| 2 | Roller arrangement for compacting longitudinal waves |
| 20 | First roller |

-continued

| List of reference symbols | |
|---|---|
| 21 | Rotational axis |
| 23 | Side region |
| 25 | Projection |
| 26 | Sleeve surface |
| 27 | Profiled peripheral surface |
| 28 | Middle region |
| 200 | Second roller |
| 210 | Rotational axis |
| 214 | Recess |
| 230 | Side region |
| 260 | Enveloping surface |
| 270 | Profiled peripheral surface |
| 280 | Middle region |
| 281 | Central region |
| 101 | Device with at least three roller arrangements 1 |
| 202 | Device with at least three roller arrangements 2 |
| 102 | Device with at least three roller arrangements 1 and at least three roller arrangements 2 |
| 105 | Hot-air supply |
| 3 | First press machine |
| 30 | First wheel, first roller |
| 300 | Second wheel, second roller |
| 4 | Second press machine |
| 40 | First wheel, first roller |
| 400 | Second wheel, second roller |
| 5 | Armor rolling machine |
| 6 | Third press machine |
| 60 | First wheel, first roller |
| 600 | Second wheel, second roller |
| 7 | Butyl feed |
| 8 | Rolling |
| 9 | Deformable material, deformable material web |
| 90 | Main expansion direction, feed direction |
| 91 | Longitudinal waves, longitudinal profile |
| 92 | Compacted longitudinal waves |
| 93 | Pressed longitudinal waves |
| 94 | Transverse waves, transverse profiling |
| 95 | Creped material |
| 111 | Sealing strip |
| 161, 171, 181, 191 | Regions of the sealing strip |
| 29 | Chimney |
| 31 | Roofing tile |

The invention claimed is:

1. A tandem roller arrangement comprising:

a first roller arrangement (1) for forming longitudinal waves (91) in a deformable material web (9), comprising a first roller (10) and a second roller (100) each with a rotational axis (11, 110), wherein each of the first and second roller (10, 100) has a contact surface (16, 160) with a wavy profile having waves that run along a circumferential direction of the contact surface and wherein each contact surface of the first and the second roller (10, 100) includes a middle region (17, 170) with a side region (18, 180) connected to the middle region on each side;

wherein the middle region (17) of the first roller (10) defines at least one projection (14) and the middle region (170) of the second roller (100) defines at least one receptacle (140) for reception of the at least one projection (14) of the first roller (10), and wherein the projection (14) is running in the receptacle (140); and wherein each side region (18) of the contact surface (16) of the first roller (10) includes wave valleys (19) and a wave crest (15) with the wave valleys (19) connecting to the middle region (17) from each side and each side region (180) of the contact surface (160) of the second roller (100) includes a wave crest (119) connecting to the middle region (170), so that the wave valleys (19) in the side regions (18) of the contact surface (16) of the first roller (10) form receptacles for the wave crests (119) in the side regions (180) of the contact surface (160) of the second roller (100), wherein the side regions (180) of the second roller (100) include a cylindrical region (115) connecting to the wave crests (119), wherein an outer surface of the cylindrical region (115) extends parallel to the rotational axis (110) so that, during operation of the first roller arrangement (1), the wave crests (15) in the side regions (18) of the first roller (10) can roll on the cylindrical region (115) in the side regions (180) of the second roller (100); and a second roller arrangement (2) for compacting the deformable material web (9) featuring longitudinal waves (91), and comprising a third roller (20) and a fourth roller (200) with respective rotational axes (21, 210), including each a profiled peripheral surface (27, 270), wherein the third roller (20) and the fourth roller (200) each have an enveloping surface (26, 260) that encloses the profiled peripheral surface (27, 270) and that is the outer surface of a cylinder about the rotational axis (21, 210) of the roller (20, 200); and wherein the third roller (20) includes a cylindrical, middle region (28) with respect to the rotational axis (21), with a side region (23) connecting to the two respective sides of this middle region with a surface running at an angle other than 180° relative to the outer surface of the cylindrical, middle region, wherein the side regions (23) of the third roller (20) define projections relative to the cylindrical, middle region (28), and wherein the fourth roller (200) includes a middle region (280) with respect to the rotational axis (210), with a side region (230) connecting to the two respective sides of this middle region with a surface running at an angle other than 180° relative to the outer surface of the middle region, wherein the side regions (230) of the fourth roller (200) are retracted in the direction of the rotational axis (210) relative to the middle region (280);

wherein the middle region (280) of the fourth roller (200) is arranged adjacent to the middle region (28) of the third roller (20) and has a central region (281) that includes a recess (214) in the central part or in the middle of the middle region (280); and wherein the first and the second roller arrangements (1, 2) are arranged in alignment one behind the other with respect to a feeding direction (90).

2. The tandem roller arrangement according to claim 1, characterized in that wave crests (14, 15; 119) and wave valleys (19; 114) of the wavy profile of the first roller arrangement (1) have an essentially semicircular cross section.

3. The tandem roller arrangement according to claim 1, characterized in that the wave crests (14, 15; 119), wave valleys (19, 114), and cylindrical regions (115) have essentially the same width measured parallel to the rotational axis (11, 110) of the roller (10, 100).

4. The tandem roller arrangement according to claim 1, characterized in that the surface of a side region (23) runs on the third roller (20) parallel to the surface of a corresponding side region (230) on the fourth roller (200).

5. The tandem roller arrangement according to claim 1, characterized in that the recess (214) has a circular arc-shaped cross section.

6. A device (101) for use during continuous production of a creped material, the device comprising multiple first roller arrangements (1) according to claim 1 that are arranged along the feeding direction (90) of the deformable material web (9) running through the device (101) during operation.

7. A device (202) for use during continuous production of a creped material, the device comprising multiple second roller arrangements (2) according to claim 1 that are arranged along the feeding direction (90) of the deformable material web (9) running through the device (202) during operation.

8. A device (102) for use during continuous production of a creped material, the device comprising multiple tandem roller arrangements according to claim 1 that are arranged along the feeding direction (90) of the deformable material web (9) running through the device (102) during operation.

9. A device (101, 202, 102) for use during continuous production of a creped material according to claim 8, characterized in that the first and second roller arrangements (1, 2) or the multiple tandem roller arrangements are arranged on a line that runs at an angle to the feeding direction (90), and/or in an essentially V-like shape and/or essentially U-like shape relative to each other.

10. A device for continuous production of a creped material, comprising:

a device for continuous feeding of a deformable material (9);

at least one device according to claim 6 for continuous formation of a longitudinal profile (91, 92) in the deformable material (9);

a device for continuous pressing of the material for producing a material with pressed longitudinal waves (93); and a device for continuous discharge of the material with pressed longitudinal waves (93).

* * * * *